United States Patent [19]

Sporrong et al.

[11] 4,342,588

[45] Aug. 3, 1982

[54] WEAR RESISTANT CAST IRON

[75] Inventors: Malte Sporrong; Lars Ramqvist, both of Nynäshamn, Sweden

[73] Assignee: Rederiaktiebolaget Nordstjernan, Stockholm, Sweden

[21] Appl. No.: 226,994

[22] Filed: Jan. 21, 1981

[30] Foreign Application Priority Data

Jan. 25, 1980 [SE] Sweden ..... 8000624

[51] Int. Cl.[3] ..... C22C 38/06

[52] U.S. Cl. ..... 75/124; 75/126 A; 75/128 D

[58] Field of Search ..... 75/124 A, 124 E, 124 F, 75/126 A, 128 D, 126 D, 128 T

[56] References Cited

U.S. PATENT DOCUMENTS

| | | | |
|---|---|---|---|
| 1,662,158 | 3/1928 | Meier | 75/124 A |
| 1,876,725 | 9/1932 | Mitchell et al. | 75/124 E |
| 1,924,344 | 8/1933 | Babinet | 75/124 A |
| 2,095,325 | 10/1937 | Flanders | 75/124 A |

*Primary Examiner*—John P. Sheehan

*Attorney, Agent, or Firm*—Pollock, Vande Sande & Priddy

[57] ABSTRACT

Wear resistant cast iron containing 3.1–3.7% carbon, 0.4–3.0% silicon, minimum 0.4% manganese, 1–7% chromium, 0–5% nickel, minimum 0.3% aluminium and 2.5–4.5% titanium.

4 Claims, 3 Drawing Figures

WEAR RESISTANT CAST IRON

The present invention relates to a wear resistant cast iron, in which titanium and chromium are the carbide forming substances. It is known that carbides of titanium and chromium in steel and cast iron increase hardness and above all wear resistance. Thus, in the Swedish Pat. No. 7504056-8 is disclosed steel alloys for grinding disks containing titanium carbide grains having a mentioned greatest size resulting in high wear resistance. However, a problem existing in alloys with titanium in steel and cast iron is that the carbide grains easily agglomerate to a netting of titanium carbides causing brittleness, particularly at high carbon content.

By the present invention it has been proved, that if a number of components in alloys are kept within comparatively narrow limits in a cast iron having a carbon content within the range of 3.1–3.7%, said problem can be controlled and an alloy having extremely good wear resistance can be achieved. In addition, some alloy components must exist in a determined relation to other alloy components in order to achieve an optimal high wear resistance. The features of the present invention required to achieve said wear resistance are set out below.

BRIEF DESCRIPTION OF THE DRAWINGS

The invention is described more in detail with reference to the accompanying drawings in which.

The cast iron alloy shall have the following composition in percentage by weight:

C: 3.1–3.7
Si: 0.4–3.0
Mn: min 0.4
Cr: 1–7
Ni: 0–5
Al: min 0.3
Ti: 2.5–4.5

The most characterizing feature of this alloy is the narrow range for the titanium content, i.e. 2.5–4.5%. Titanium contents below 2.5% result in deteriorated wear resistances, while titanium content above 4.5% rapidly causes brittleness, partly as a result of too great agglomeration and netting formation, which probably is a result of required higher casting temperatures. This narrow titanium content range is also highly due to and a result of the fact that the carbon content range is kept within narrow limits of 3.1–3.7%, which also has been proved to be necessary for maintaining the control of the carbide formation.

Figure 1:
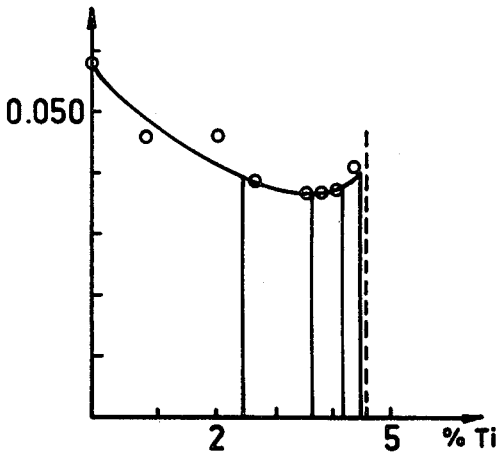
FIG. 1 is a graph showing the relationship between wear and titanium concentration.

A series of wear tests on alloys the composition of which have been substantially constant within above mentioned analysis limits except for the titanium content, have resulted in the fact that wear and brittle fracture qualities respectively give a utility maximum at about 4% titanium. Preferably, the titanium content should be 3.7–4.2%. FIG. 1 shows the wear decrease in relation of the titanium content in performed wear tests, in which tests the wear decrease have been measured as a weight decrease per unit of surface area. The spread of the test results is probably dependent on the variations in the composition and varying solidification conditions. Brittle fracture takes place over 4.5% titanium, which in FIG. 1 is indicated by a dashed line. Particularly for cast iron pieces in the order of magnitude of one kilogram and greater, titanium contents above 4.5% result in an unacceptable low ductility.

Optimum high wear qualities are obtained if the silicon content in a preferred alloy composition is kept within the range 0.4–2.7%. Preferably, the relationship carbon-silicon should in percentage by weight follow the formula:

$$C = -0.27Si + (3.73 \pm 0.1).$$

Figure 2:
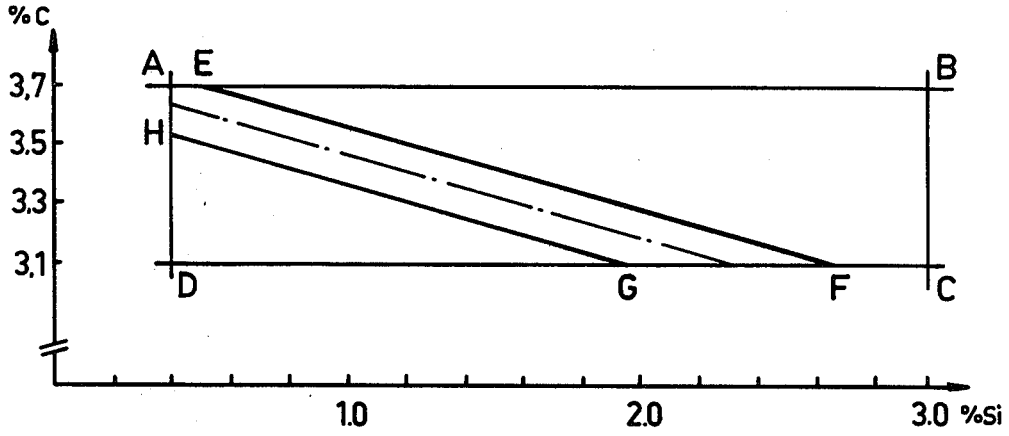
FIG. 2 is a graph showing the relationship between the concentrations of carbon and silicon for a preferred alloy.

The reasons for this are, that the graphitization within this carbon-silicon range has proved to have a minimum, which for the wear qualities is of the utmost significance. The separation of free graphite can be observed and its extent be measured by using a microscope. By counting the number of graphite grains or flakes per surface unit and judging their size, the extent of the graphitization is estimated. The result of such an estimation combined with wear tests has resulted in the limits for silicon concentration mentioned above. These limits and the relationship carbon-silicon according to a preferred composition of the alloy are illustrated in FIG. 2. The line AB illustrates the upper carbon content limit and the line DC the lower carbon content limit. The area AEFGH shows the preferred relationship carbon-silicone according to above stated formula.

Improved wear qualities can also be achieved if nickel is added to the alloy. The nickel content, however, must not exceed 5%, since nickel contents above this value result in a striking deterioration of the wear resistance, among other things due to the fact that nickel like silicon promotes graphitization, however to a considerably less extent. For silicon contents between 2.0–3.0% the nickel content ought accordingly to be further limited. In a preferred alloy composition the nickel content shall in silicon content range of 2.0–3.0% be limited according to the formula:

$$Ni \leqq -5.0Si + 15.0.$$

Figure 3:
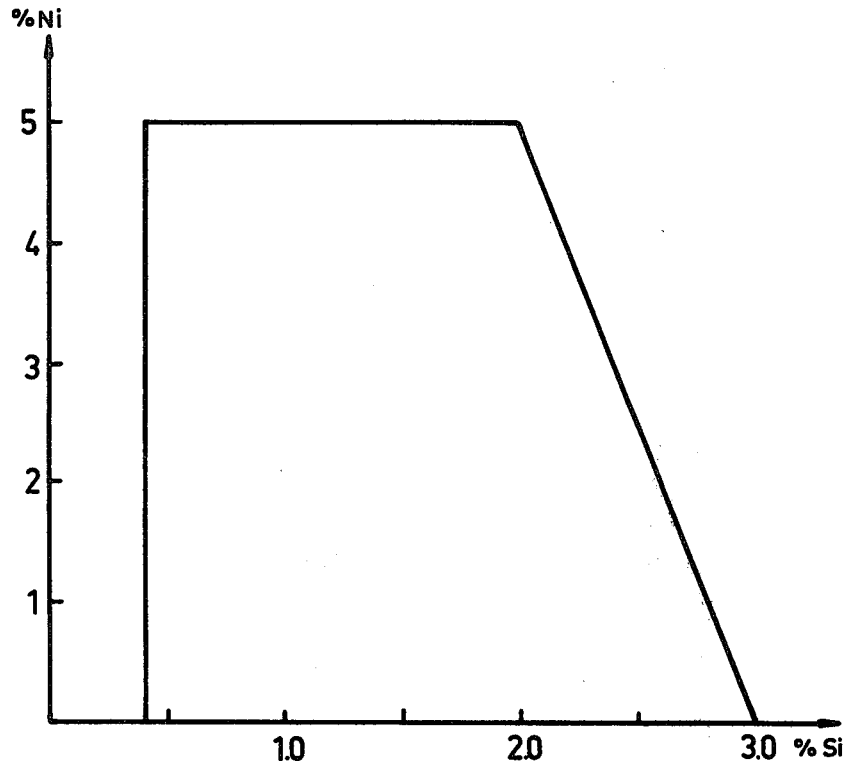
FIG. 3 shows the concentration of nickel as a function of the concentration of silicon.

The limits for the nickel content mentioned above are illustrated in FIG. 3 showing nickel concentration as a function of silicon concentration.

Out of the remaining alloy substances chromium as well as titanium is a carbide former. Chromium carbide is not as hard as titanium carbide but assists the latter in achieving the high wear qualities. It has been proved, that chromium contents between 1–7% effectively contribute to high wear qualities. Chromium contents between 2–4% seem to give most favourable results and are preferred.

Aluminium is for this alloy necessary as densifying agent. A content of at least 0.3% is required, preferably at least 0.8%. Moreover, from known reasons the manganese content ought to be at least 0.4% and the contents of phosphorous and sulphur ought to be below 0.3% each.

It is known, that molybdenum assures a good wetting to titanium carbide in iron and steel melt. However, it has been proved that a molybdenum addition to the present cast iron alloy has not given any increased wear resistance.

Finally, is shall be noted, that by the present cast iron alloy extremely high wear qualities are achieved with comparatively low contents of alloy substances. This is of great economic significance in times when the prices of alloy substances constantly are increasing.

We claim:

1. Wear-resistant cast iron characterized in that it contains 3.1–3.7% carbon, 0.4–3.0% silicon, a minimum of 0.4% manganese, 1–7% chromium, 0–5% nickel, a minimum of 0.3% aluminum, and 3.7–4.2% titanium, the balance being predominantly iron.

2. Cast iron according to claim 1 characterized in that the silicon content is 0.4–2.7%.

3. Cast iron according to claim 2 characterized in that the silicon content is determined by the formula $C = -0.27\ Si + (3.73 \pm 0.1)$ in which C and Si are expressed in percent by weight.

4. Cast iron according to claim 1 characterized in that the silicon content is between 2.0 and 3.0% and the Ni content is determined by the formula $Ni = -5.0Si + 15.0$ in which Ni and Si are expressed in percent by weight.

* * * * *